US009491842B2

(12) United States Patent
Chen et al.

(10) Patent No.: US 9,491,842 B2
(45) Date of Patent: Nov. 8, 2016

(54) METHODS FOR CONTROLLING STANDING WAVE ACCELERATOR AND SYSTEMS THEREOF

(71) Applicants: Nuctech Company Limited, Haidian District, Beijing (CN); Tsinghua University, Haidian District, Beijing (CN)

(72) Inventors: Huaibi Chen, Beijing (CN); Jianping Cheng, Beijing (CN); Shuxin Zheng, Beijing (CN); Jiaru Shi, Beijing (CN); Chuanxiang Tang, Beijing (CN); Qingxiu Jin, Beijing (CN); Wenhui Huang, Beijing (CN); Yuzheng Lin, Beijing (CN); Dechun Tong, Beijing (CN); Shi Wang, Beijing (CN)

(73) Assignees: Nuctech Company Limited, Haidian District, Beijing (CN); Tsinghua University, Haidian District, Beijing (CN)

( * ) Notice: Subject to any disclaimer, the term of this patent is extended or adjusted under 35 U.S.C. 154(b) by 20 days.

(21) Appl. No.: 14/487,960

(22) Filed: Sep. 16, 2014

(65) Prior Publication Data

US 2015/0084549 A1 Mar. 26, 2015

(30) Foreign Application Priority Data

Sep. 22, 2013 (CN) ..... 2013 1 0449294

(51) Int. Cl.
*H05H 9/04* (2006.01)
*H05H 7/02* (2006.01)

(52) U.S. Cl.
CPC ..... *H05H 9/04* (2013.01); *H05H 9/048* (2013.01); *H05H 2007/027* (2013.01)

(58) Field of Classification Search
CPC ..... H05H 9/048; H05H 9/04
USPC ..... 315/503, 505, 5.41
See application file for complete search history.

(56) References Cited

U.S. PATENT DOCUMENTS 2,920,288 A 1/1960 Lair
3,070,726 A 12/1962 Mallory (Continued)

FOREIGN PATENT DOCUMENTS

CN 1102829 C 12/1999
CN 1599537 A 3/2005
JP S63-274098 A 11/1988

OTHER PUBLICATIONS

Chinese Office Action for corresponding Chinese Patent Application No. 201310449294.1 mailed Jul. 21, 2016 with English translation, 12 pgs.

*Primary Examiner* — Douglas W Owens
*Assistant Examiner* — Jonathan Cooper
(74) *Attorney, Agent, or Firm* — Merchant & Gould P.C.

(57) ABSTRACT

The present disclosure discloses a method for controlling a standing wave accelerator and a system thereof. The method comprises: generating, by an electron gun, an electron beam; injecting the electron beam into an accelerating tube; and controlling a microwave power source to generate and input microwave with different frequencies into the accelerating tube, so that the accelerating tube switches between different resonant modes at a predetermined frequency to generate electron beams with corresponding energy. According to the above solution, it only needs to change the output frequency of the microwave power source in the process of adjusting energy, without making any change to the accelerating structure per se. Therefore, the method is easy to operate. In addition, the structure of the accelerating tube in the above system is simple, without adding a particular regulation apparatus.

9 Claims, 4 Drawing Sheets

(56) References Cited

U.S. PATENT DOCUMENTS 4,118,653 A 10/1978 Vaguine
4,286,192 A 8/1981 Tanabe et al.
7,112,924 B2 * 9/2006 Hanna ..... H05H 7/18 315/5.41
2010/0289436 A1 11/2010 Alimov et al.
2012/0200238 A1 * 8/2012 Sierra ..... H05H 9/04 315/505

* cited by examiner

METHODS FOR CONTROLLING STANDING WAVE ACCELERATOR AND SYSTEMS THEREOF

This application claims benefit of Serial No. 201310449294.1, filed 22 Sep. 2013 in China and which application is incorporated herein by reference. To the extent appropriate, a claim of priority is made to the above disclosed application.

TECHNICAL FIELD

The present disclosure relates to the field of accelerators, and more particularly, to the field of medical and industrial accelerators.

BACKGROUND

The electron linear accelerator is a device which accelerates electrons under a microwave electromagnetic field so that the energy of the electrons is enhanced. An electron beam generated by using the accelerator has a widespread application prospect, such as medical treatment, irradiation, imaging, etc.

In order to acquire maximum acceleration efficiency, all conventional electron linear accelerators are designed so that a variation in a phase velocity of the microwave is consistent with a variation in a movement velocity of the accelerated electrons. According to the theory of relativity, as the energy of the electrons has improved, the movement velocity of the electrons approaches the light velocity rapidly. Therefore, when a conventional low-energy electron linear accelerator is designed, it is generally divided into a bunching section and a light velocity section. In the bunching section, the phase velocity of the microwave increases slowly. A variation in the phase velocity is substantially the same as a variation in the velocity of the electrons, to ensure particular capture efficiency and an energy spectrum. In the light velocity section, the phase velocity is equal to the light velocity, and the movement velocity of the electrons also approaches the light velocity. Therefore, the electrons are also synchronous with the microwave, and the phase of the electrons is near the maximum accelerating phase, to obtain optimal accelerating efficiency.

In general, the output energy of the electron linear accelerator is fixed. However, in practical applications, it is generally desired to adjust the energy of the accelerator as needed. In order to adapt to the requirements of the practical applications, various methods for adjusting energy appear successively. At present, methods for adjusting energy commonly used by the electron linear accelerator comprise:

(1) changing an overall electromagnetic field distribution of the accelerating tube. This is generally implemented by regulating feed-in microwave power or a beam load. This method is relatively easy to implement, but in order to ensure that the capture efficiency and beam energy spectrum of the bunching section, the variation of the field amplitude can not be too large, and therefore the energy regulating range is limited.

(2) keeping the field amplitude of the bunching section substantially unchanged, and individually changing a field amplitude or phase of the light velocity section. There are generally two implementation manners for this solution at present: one is to feed energy into the bunching section and the light velocity section separately to achieve the purpose of independent regulation, such as U.S. Pat. No. 2,920,288, U.S. Pat. No. 3,070,726 and U.S. Pat. No. 4,118,653; and the other is to regulate a field amplitude ratio or phase relationship between the bunching section and the light velocity section by an energy switch, such as U.S. Pat. No. 4,286,192 and CN patent CN 1102829 C. This method can obtain a relatively large energy regulating range, but the structure of the microwave feed-in system or the accelerator is relatively complex.

SUMMARY

In consideration of one or more problems in the prior art, a method for controlling a standing wave accelerator and a system thereof are proposed.

In an aspect of the present disclosure, a method for controlling a standing wave accelerator is provided, comprising: generating, by an electron gun, an electron beam; injecting the electron beam into an accelerating tube; and controlling a microwave power source to generate and input microwave with different frequencies into the accelerating tube, so that the accelerating tube switches between different resonant modes at a predetermined frequency to generate electron beams with corresponding energy.

According to some embodiments, the different resonant modes comprise a $\pi/2$ mode or another adjacent mode, and energy of the electron beams corresponding to the two modes are at high-energy level and low-energy level respectively.

According to some embodiments, the electron beam is synchronous with the microwave at the high-energy level; and the electron beam is asynchronous with the microwave at the low-energy level.

According to some embodiments, both a frequency of the microwave in the $\pi/2$ mode and a frequency of the microwave in another adjacent mode are within a frequency regulating range of the microwave power source.

According to some embodiments, the microwave power source is a magnetron, an output frequency of which is adjusted so that the accelerating tube switches between the $\pi/2$ mode and a $5\pi/14$ mode or switches between the $\pi/2$ mode and a $9\pi/14$ mode.

In another aspect of the present disclosure, a system for accelerating an electron beam is provided, comprising: an electron gun configured to generate an electron beam; a microwave power source configured to generate microwave with different frequencies; an accelerating tube comprising an electron input port and a microwave feed-in port, wherein the electron input port is coupled to an output port of the electron gun to receive the electron beam, and the microwave feed-in port is coupled to an output port of the microwave power source to feed the microwave generated by the microwave power source into the accelerating tube; and a control apparatus coupled to the microwave power source and the electron gun to control the microwave power source to generate microwave with different frequencies so that the accelerating tube switches between different resonant modes to generate electron beams with corresponding energy.

According to the above solution, it only needs to change the output frequency of the microwave power source in the process of adjusting energy, without making any change to the accelerating structure per se. Therefore, the method is easy to operate. In addition, the structure of the accelerating tube in the system is simple, without adding a particular regulation apparatus.

BRIEF DESCRIPTION OF THE DRAWINGS

In order to better understand the present disclosure, the embodiments of the present disclosure will be described according to the following accompanying drawings.

DETAILED DESCRIPTION OF THE PREFERRED EMBODIMENTS

Figure 1:
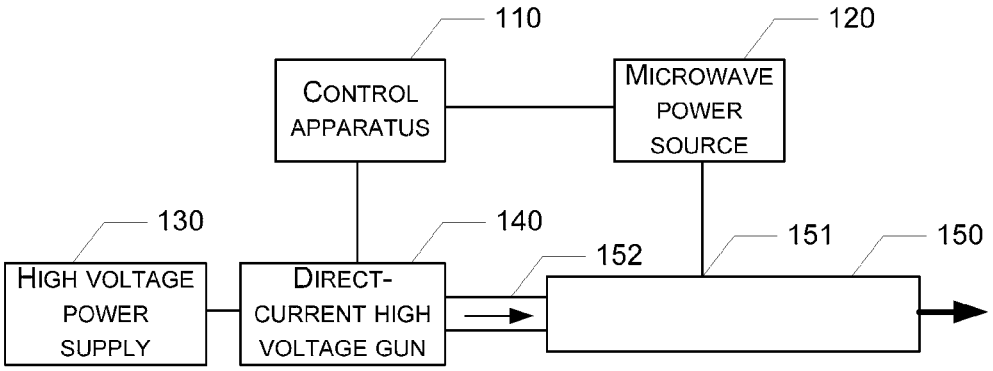
FIG. 1 illustrates a structural schematic diagram of a system for accelerating an electron beam according to an embodiment of the present disclosure.

Specific embodiments of the present disclosure will be described below in detail. It should be noted that the embodiments described herein are illustrated merely by way of example instead of limiting the present disclosure. In the following description, numerous specific details are set forth in order to provide a thorough understanding of the present disclosure. However, it is obvious to those skilled in the art that the present disclosure may be practiced without these specific details. In other instances, well known circuits, materials or methods have not been described in detail to avoid obscuring the present disclosure.

Reference throughout this specification to "one embodiment", "an embodiment", "one example" or "an example" means that a particular feature, structure, or characteristic described in connection with the embodiment or example is included in at least one embodiment of the present disclosure. Thus, the appearances of the phrase "in one embodiment", "in an embodiment", "one example" or "an example" in various places throughout this specification are not necessarily all referring to the same embodiment or example. Furthermore, the particular features, structures, or characteristics may be combined in any suitable combination and/or sub-combination in one or more embodiments or examples. In addition, those skilled in the art should understand that the accompanying drawings provided herein are illustrative, and are not necessarily drawn to scale. It should be understood that when an element is recited as being "coupled to" or "connected to" another element, the element can be directly coupled or coupled to the further element, or otherwise there may be an intervening element interposed therebetween. In contrary, when an element is recited as being "directly coupled to" or "directly connected to" another element, there is no intervening element interposed therebetween. The same reference numbers are used to refer to the same elements. A term "and/or" used herein comprises any or all combinations of one or more listed related items.

In order to provide a standing wave electron linear accelerator apparatus which outputs at more than two energy levels, for example, the output energy of the electrons is at a 100 keV energy level and one or more MeV energy levels respectively, a method for controlling a standing wave accelerator is proposed. According to the method, an electron beam is generated by an electron gun and then is injected into an accelerating tube. A microwave power source is controlled to generate and input microwave with different frequencies into the accelerating tube, so that the accelerating tube switches between different resonant modes at a predetermined frequency, to generate electron beams with corresponding energy. Thus, a method for adjusting energy output from the standing wave accelerator in a mode hopping manner can be provided. The method according to the embodiment can obtain a large energy regulating range without increasing the complexity of the accelerator, thereby enabling one accelerator to output electron beams at both MeV energy level and 100 keV energy level.

FIG. 1 illustrates a structural schematic diagram of a system for accelerating an electron beam according to an embodiment of the present disclosure. As shown in FIG. 1, the system for accelerating an electron beam according to the embodiment includes a direct-current high voltage gun 140, a high voltage power supply 130, an accelerating tube 150, a microwave power source 120 and a control apparatus 110. In the embodiment illustrated in the figure, the high voltage power supply 130 supplies power to the direct-current high voltage gun (electron gun) 140, to generate an electron beam. The microwave power source 120 generates microwave with different frequencies under the control of the control apparatus 110. The accelerating tube 150 includes an electron input port 152 and a microwave feed-in port 151. The electron input port 152 is coupled to an output port of the direct-current high voltage gun 140 to receive the electron beam generated by the direct-current high voltage gun 140. The microwave feed-in port 151 is coupled to an output port of the microwave power source 120 to feed the microwave generated by the microwave power source 120 into the accelerating tube, so as to accelerate the electron beam. The control apparatus 110 is coupled to the microwave power source 120 and the direct-current high voltage gun 14, to control the microwave power source 120 to generate microwave with different frequencies, so that the accelerating tube 150 switch between different resonant modes to generate electron beams with corresponding energy.

Figure 2:
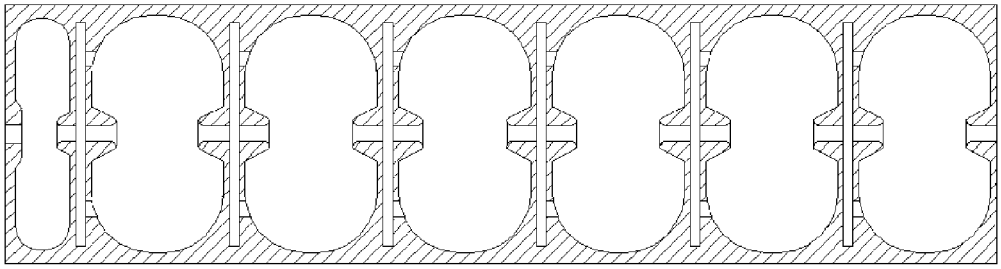
FIG. 2 illustrates a sectional view of an accelerating tube in the system illustrated in FIG. 1.
Figure 4:
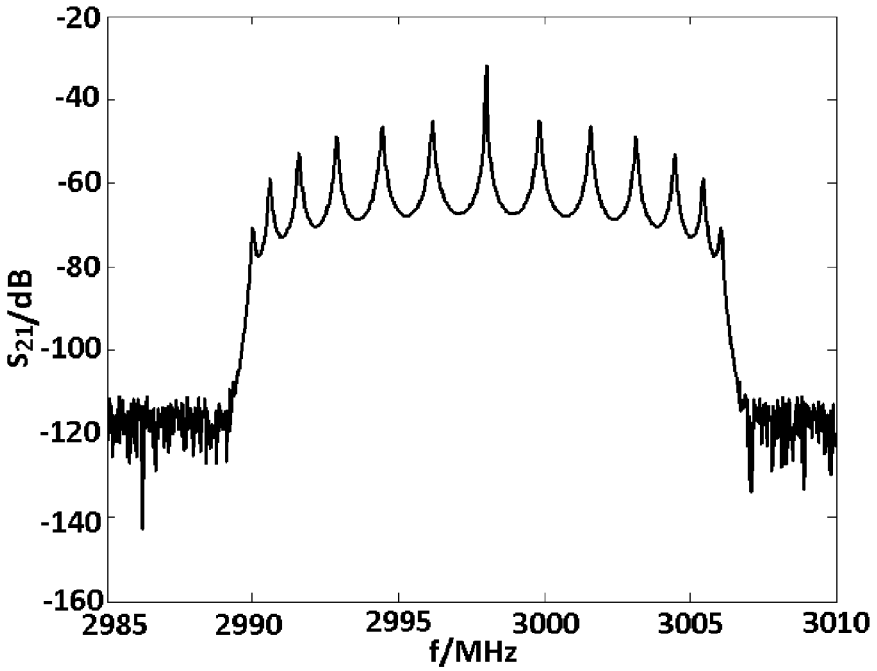
FIG. 4 illustrates a diagram of a resonant mode distribution of a chain of microwave resonant cavities according to an embodiment of the present disclosure.

FIG. 2 illustrates a sectional view of an accelerating tube in the system illustrated in FIG. 1. As shown in FIG. 2, a core part in the accelerator is the accelerating tube, which is comprised of a chain of microwave resonant cavities and establishes a microwave electromagnetic field to accelerate electrons. The chain of resonant cavities may be in multiple resonant modes and operate at different resonant frequencies. Phase relations between adjacent cavities in the chain of resonant cavities are different in various resonant modes. FIG. 4 illustrates a diagram of a resonant mode distribution of a chain of microwave resonant cavities according to an embodiment of the present disclosure. A chain of N resonant cavities may generally be in N resonant modes, and phase differences between cavities are respectively:

$$\frac{q\pi}{N+1}(q = 1, 2, \ldots N) \tag{1}$$

In addition, if an accelerating tube is designed with a cavity length relation that a sum of lengths of four cavities is equal to one microwave wavelength, the electrons are synchronous with the microwave in the π/2 mode, and maximum energy is obtained. In adjacent modes such as $$\left(\frac{1}{2} \pm \frac{1}{N+1}\right)\pi \quad (2)$$

or $$\left(\frac{1}{2} \pm \frac{2}{N+1}\right)\pi$$

As the electrons are asynchronous with the microwave, low energy is obtained. If the operating energy in the π/2 mode is 6 MeV, the output energy in the adjacent mode is 1 MeV or hundreds of keV.

According to some embodiments, the frequencies of the accelerating tube in the π/2 mode and the adjacent mode are in the frequency regulating range of the microwave power source. The frequency of the microwave power source is regulated so that the accelerating tube operates in the π/2 mode or another adjacent mode, and output energy of the electron beam corresponding to the π/2 mode and another adjacent mode are at a high-energy level and a low-energy level respectively.

Figure 3:
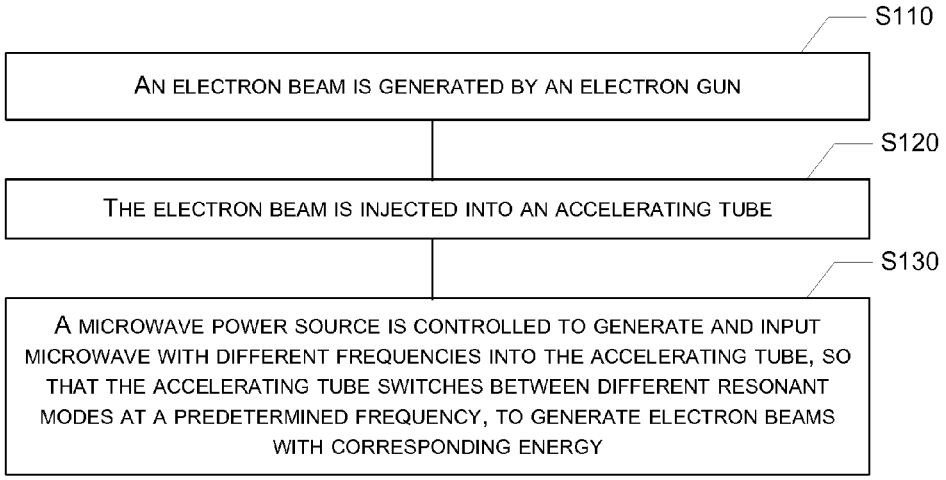
FIG. 3 is a flowchart illustrating a method for controlling a standing wave accelerating tube according to an embodiment of the present disclosure.

FIG. 3 is a flowchart illustrating a method for controlling a standing wave accelerating tube according to an embodiment of the present disclosure. As shown in FIG. 3, at step S110, an electron beam is generated by an electron gun. For example, a control apparatus 110 controls a direct-current high voltage gun 140 to generate an electron beam.

At step S120, the electron beam is injected into the accelerating tube. For example, the electron beam generated by the direct-current high voltage gun 140 is input into an accelerating tube 150 via an electron input port 152 of the accelerating tube.

At step S130, the microwave power source 120 is controlled to generate and input microwave with different frequencies into the accelerating tube 150 via a microwave feed-in port, so that the accelerating tube 150 switches between different resonant modes at a predetermined frequency, to generate electron beams with corresponding energy.

According to the above embodiments, the energy is adjusted in a mode hopping manner, i.e., the phase of the electrons relative to the microwave is changed by changing the resonant mode of the accelerating tube, so that a large change occurs in the microwave electromagnetic field intensity to which electrons are subjected, so as to achieve the purpose of energy adjustment. The frequency of the microwave power source is changed so that the accelerating tube operates in different resonant modes to generate electron beams with different energy, so as to meet the practical needs.

According to some embodiments, it only needs to change the output frequency of the microwave power source in the process of adjusting energy, without making any change to the accelerating structure per se. Therefore, the method is easy to operate. In addition, the structure of the accelerating tube is simple, without adding a particular regulation apparatus.

Figure 5:
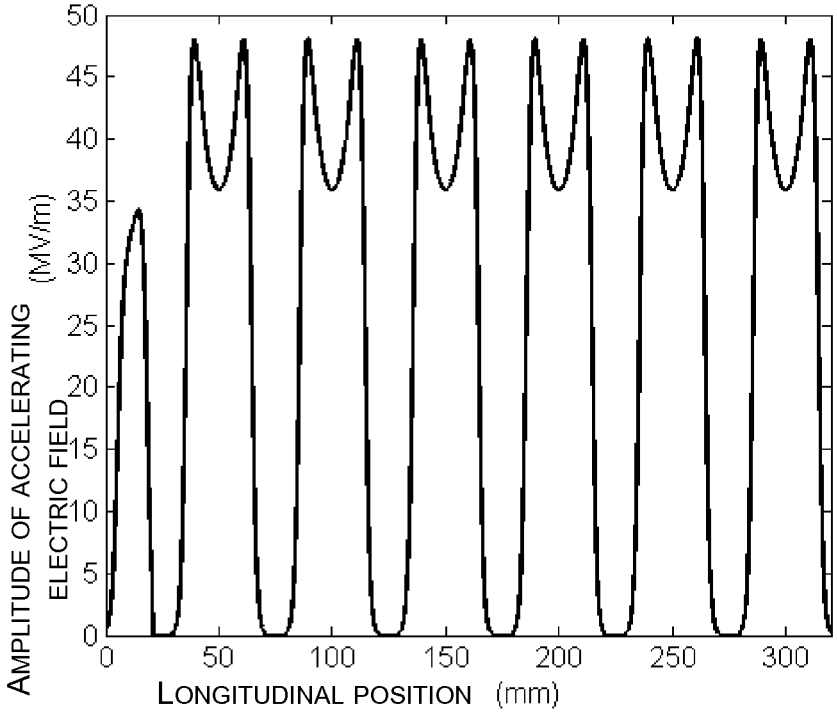
FIG. 5 illustrates a diagram of an electric field amplitude distribution when an accelerating tube is at a 6 MeV level according to an embodiment of the present disclosure.
Figure 6:
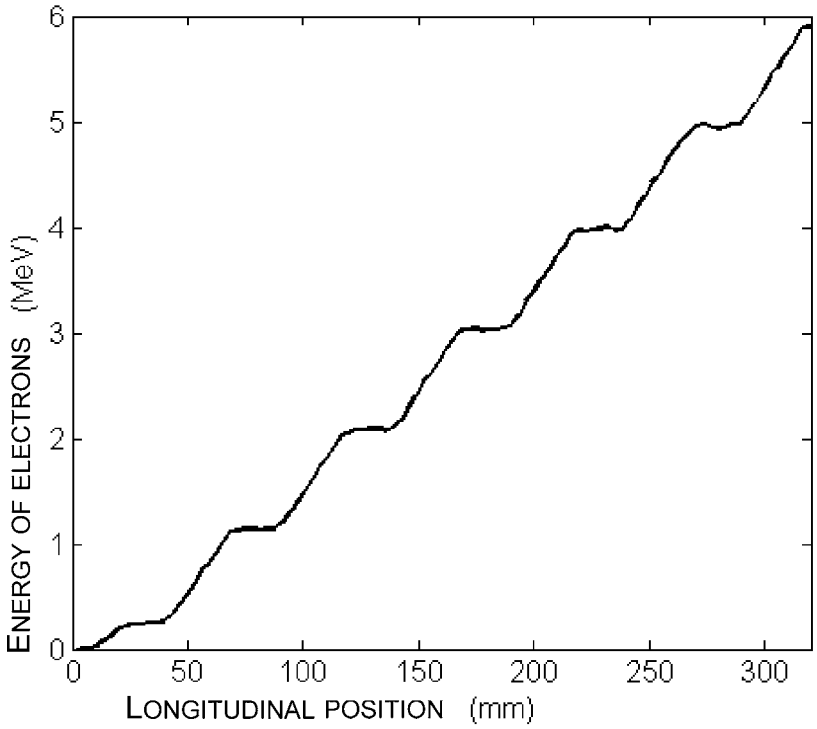
FIG. 6 illustrates a diagram of an energy variation when an accelerating tube is at a 6 MeV level according to an embodiment of the present disclosure.
Figure 7:
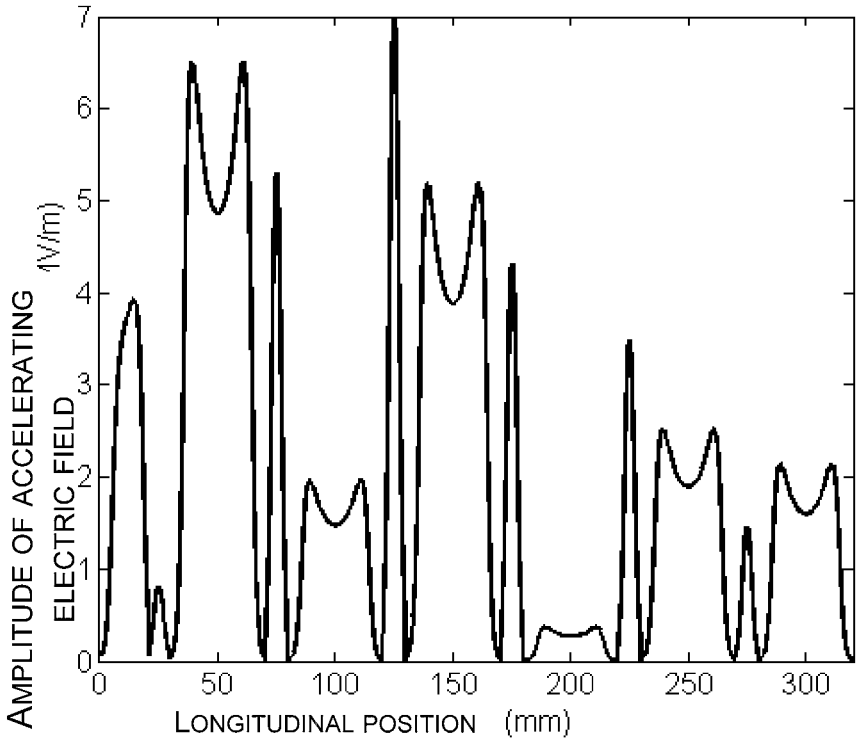
FIG. 7 illustrates a diagram of an electric field amplitude distribution when an accelerating tube is at a 100 keV level according to an embodiment of the present disclosure.
Figure 8:
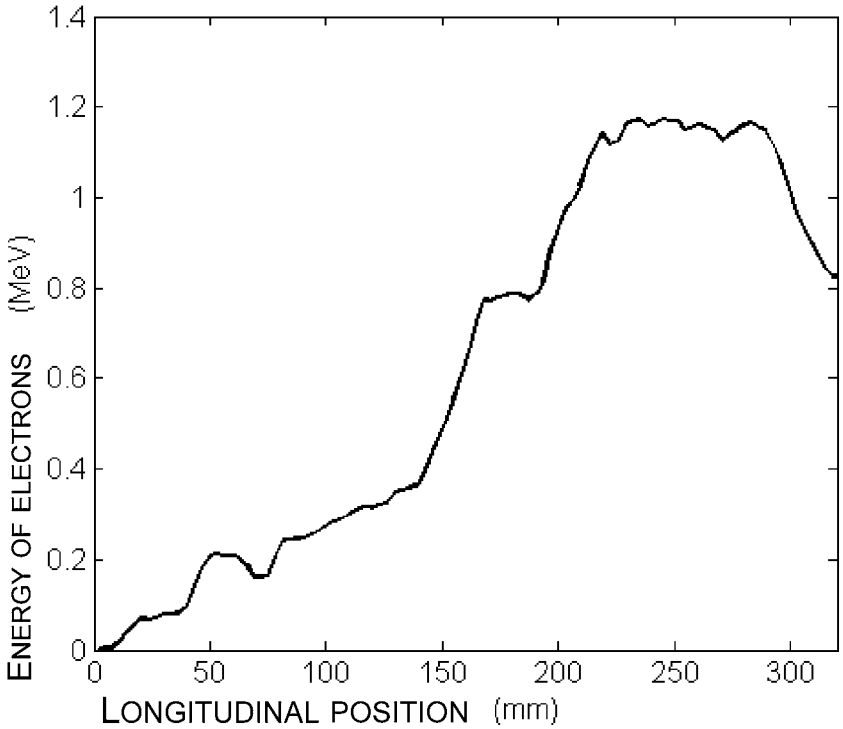
FIG. 8 illustrates a diagram of an energy variation of electrons when an accelerating tube is at a 100 keV level according to an embodiment of the present disclosure.

In some embodiments, the above mode hopping manner is used to enable the standing wave accelerator to implement adjustment of output energy and operate at both hundreds of keV and 6 MeV energy levels. For example, parameters of the accelerating tube are selected to enable the accelerating tube to include 13 cavities. A frequency distribution of 13 possible operating modes thereof is as shown in FIG. 4. With reference to FIG. 4, a transmission characteristics between two probes obtained after excitation by inserting microwave probes in beam holes at both ends is illustrated, where a horizontal coordinate is an excitation frequency, and a longitudinal coordinate is amplitude of a transmission signal between the probes. Each peak in the curve of FIG. 4 corresponds to each possible operating mode of the accelerating tube, so that an operating frequency of the π/2 mode is 2998 MHz, an operating frequency of the 5π/14 mode is 3002 MHz, and an operating mode of the 9π/14 mode is 2994 MHz; and a field intensity distribution and an energy variation process of the electrons in the accelerating tube in the π/2 mode are as shown in FIGS. 5 and 6 respectively. FIG. 5 is a diagram of an electric field distribution of an accelerating tube along an axis line in the π/2 mode, where a horizontal coordinate is a longitudinal position along the accelerating tube, and a longitudinal coordinate is amplitude of the accelerating electric field. FIG. 6 is an energy variation of electrons in an accelerating tube with a longitudinal position in the π/2 mode, where a horizontal coordinate is a longitudinal position along the accelerating tube, and a longitudinal coordinate is kinetic energy of electrons in the accelerating tube. A field intensity distribution and an energy variation process of the electrons in the accelerating tube in the 9π/14 mode are as shown in FIGS. 7 and 8 respectively. FIG. 7 is a diagram of an electric field distribution of an accelerating tube along an axis line in the 9π/14 mode, where a horizontal coordinate is a longitudinal position along the accelerating tube, and a longitudinal coordinate is amplitude of an accelerating electric field. FIG. 8 is an energy variation of electrons in an accelerating tube with a longitudinal position in the 9π/14 mode, where a horizontal coordinate is a longitudinal position along the accelerating tube, and a longitudinal coordinate is kinetic energy of electrons in the accelerating tube.

The output frequency range of a magnetron is selected to be 2993-3003 MHz. An output frequency of the magnetron is adjusted so that the accelerating tube operates in the π/2 mode and a 9π/14 mode (or a 5π/14 mode) respectively, thereby implementing two energy of electron beams.

While the present disclosure has been described with reference to several typical embodiments, it should be understood that the terms used herein are illustrative and exemplary terms instead of restrictive terms. As the present disclosure can be implemented in many forms without departing from the spirit or substance of the present disclosure, it should be understood that the above embodiments are not limited to any detail described above, and instead, should be widely explained in the spirit and scope defined by the appended claims, and thus any change and variation falling into the scope of the claims or equivalents thereof should be encompassed by the appended claims.

What is claimed is:

1. A method for controlling a standing wave accelerator, comprising:

generating, by an electron gun, an electron beam;

injecting the electron beam into an accelerating tube; and controlling a microwave power source to generate and input microwave with different frequencies into the accelerating tube, so that the accelerating tube switches between different resonant modes at a predetermined frequency to generate electron beams with corresponding energy levels.

2. The method according to claim 1, wherein the different resonant modes comprise a π/2 resonant mode and another adjacent resonant mode, and energy of the electron beams corresponding to the two resonant modes are at high-energy level and low-energy level respectively.

3. The method according to claim 2, wherein the electron beam is synchronous with the microwave at the high-energy level; and the electron beam is asynchronous with the microwave at the low-energy level.

4. The method according to claim 1, wherein both a frequency of the microwave in the $\pi/2$ resonant mode and a frequency of the microwave in another adjacent resonant mode are within a frequency regulating range of the microwave power source.

5. The method according to claim 1, wherein the microwave power source is a magnetron, an output frequency of which is adjusted so that the accelerating tube switches between the $\pi/2$ resonant mode and a $5\pi/14$ resonant mode or switches between the $\pi/2$ resonant mode and a $9\pi/14$ resonant mode.

6. A system for accelerating an electron beam, comprising:

an electron gun configured to generate an electron beam;

a microwave power source configured to generate microwave with different frequencies;

an accelerating tube comprising an electron input port and a microwave feed-in port, wherein the electron input port is coupled to an output port of the electron gun to receive the electron beam, and the microwave feed-in port is coupled to an output port of the microwave power source to feed the microwave generated by the microwave power source into the accelerating tube; and a control apparatus coupled to the microwave power source and the electron gun to control the microwave power source to generate microwave with different frequencies so that the accelerating tube switches between different resonant modes at a predetermined frequency to generate electron beams with corresponding energy levels.

7. The system according to claim 6, wherein the different resonant modes comprise a $\pi/2$ resonant mode and another adjacent resonant mode, and energy of the electron beams corresponding to the two resonant modes are at high-energy level and low-energy level respectively.

8. The system according to claim 7, wherein the electron beam is synchronous with the microwave at the high-energy level; and the electron beam is asynchronous with the microwave at the low-energy level.

9. The system according to claim 6, wherein the microwave power source is a magnetron, an output frequency of which is adjusted so that the accelerating tube switches between the $\pi/2$ resonant mode and a $5\pi/14$ resonant mode or switches between the $\pi/2$ resonant mode and a $9\pi/14$ resonant mode.

* * * * *